United States Patent [19]

Hamme

[11] Patent Number: 4,481,796

[45] Date of Patent: Nov. 13, 1984

[54] MORTISE LOCK PROVIDED WITH BOLT AND LATCH

[75] Inventor: Kurt Hamme, Berlin, Fed. Rep. of Germany

[73] Assignee: Zeiss Ikon AG, Berlin, Fed. Rep. of Germany

[21] Appl. No.: 284,988

[22] Filed: Jul. 20, 1981

[30] Foreign Application Priority Data

Jul. 19, 1980 [DE] Fed. Rep. of Germany ..... 3027462

[51] Int. Cl.[3] ..... E05D 59/04

[52] U.S. Cl. ..... 70/107

[58] Field of Search ..... 70/107, 109, 110, 111

[56] References Cited

U.S. PATENT DOCUMENTS

| | | | |
|---|---|---|---|
| 589,940 | 9/1897 | Dunning | 70/110 |
| 833,301 | 10/1906 | Carroll et al. | 70/107 |
| 1,057,874 | 4/1913 | Paluh | 70/107 |
| 1,290,439 | 1/1919 | Weller | 70/107 |
| 1,677,012 | 7/1928 | Arigi | 70/107 |
| 1,974,769 | 9/1934 | Elliott | 70/107 |
| 2,638,770 | 5/1953 | Gutman | 70/107 |
| 3,672,714 | 6/1972 | Schultz | 70/107 X |

FOREIGN PATENT DOCUMENTS

| | | | |
|---|---|---|---|
| 78106 | 5/1884 | Fed. Rep. of Germany | 70/107 |
| 90300 | 1/1897 | Fed. Rep. of Germany | 70/111 |
| 609898 | 2/1935 | Fed. Rep. of Germany | 70/107 |
| 852962 | 10/1952 | Fed. Rep. of Germany | 70/107 |
| 566784 | 9/1957 | Italy | 70/107 |
| 636464 | 5/1950 | United Kingdom | 70/107 |

*Primary Examiner*—Gary L. Smith
*Assistant Examiner*—Russell W. Illich
*Attorney, Agent, or Firm*—Hill, Van Santen, Steadman & Simpson

[57] ABSTRACT

A mortise lock having both a latch and a bolt which are capable of being simultaneously retracted or engaged by either a door handle or a key, and which are able to be maintained in a retracted or engaged mode as desired by the user.

9 Claims, 3 Drawing Figures

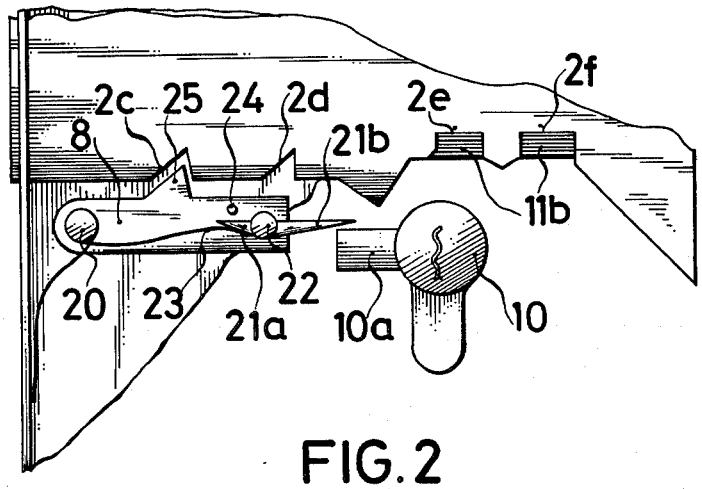
FIG. 2
FIG. 3
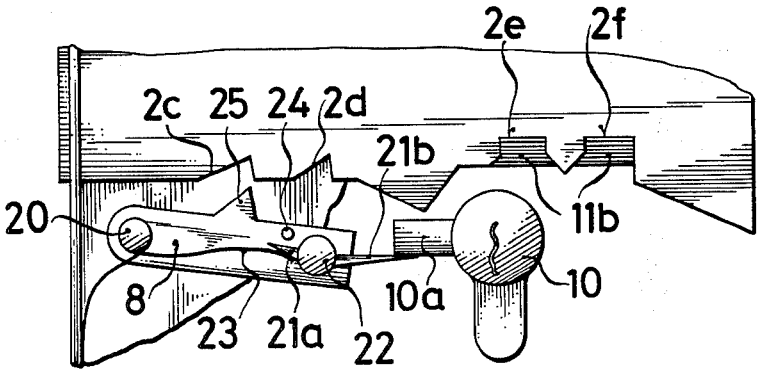

MORTISE LOCK PROVIDED WITH BOLT AND LATCH

BACKGROUND OF THE INVENTION

1. Field of the Invention:

The invention relates to a mortise lock having a bolt and latch which are activated by means of a rotary cylinder lock as well as by means of an inside door handle and being particularly useful for providing security for dwellings.

2. Prior Art:

The term "Mortise lock" applies to any lock within a mortise in a door or the like so that the lock is covered on both sides.

SUMMARY OF THE INVENTION

This invention relates to a means for providing expanded security to a dwelling owner by means of an advance design for a mortise lock. This invention comprises a bolt member which is biased in the forward or engaged mode by means such as a spring and which is actuated by means of a rotary cylinder lock. The movement of the bolt is controlled by means of a lever connection consisting of two levers which move the bolt automatically into its locking position when a latch member is pressed or retracted. Likewise, the bolt may be withdrawn when the door is slammed shut as well as upon actuation by the door handle.

A bolt control lever having a release and a blocking element is guided by one lever of the lever connection and cooperates with one or more ratchets formed on the bolt in such a manner that when the bolt is retracted into the lock case, it is secured against being advanced. In the same manner, the bolt, which automatically springs into its lock position when the latch is pressed or withdrawn or upon actuation of the latch by the door handle, is prevented from being retracted into the lock case unless so desired by the user. When the latch member is pressed or upon actuation of the latch member by the door handle, the bolt control lever is lifted out of its blocking position with respect to the bolt by means of a follower pin attached to the aforementioned one lever of the lever connection in such a manner that the bolt is able to spring forward twice and that the bolt control lever is subsequently lowered back into its blocking position behind the nose.

Because the lock bolt exhibits ratchets which engage locking elements of the bolt control lever, the bolt which is situated in the lock case is secured against unauthorized advance and also, that the previously closed or advanced bolt is secured against being forced back. Thus, in order to advance or retract the bolt, both blockages must be eliminated by means of the bolt control lever.

BRIEF DESCRIPTION OF THE DRAWINGS

FIGS. 2 and 3 are fragmentary sectional views of portions of the mortise lock.

DESCRIPTION OF THE PREFERRED EMBODIMENTS

Figure 1:
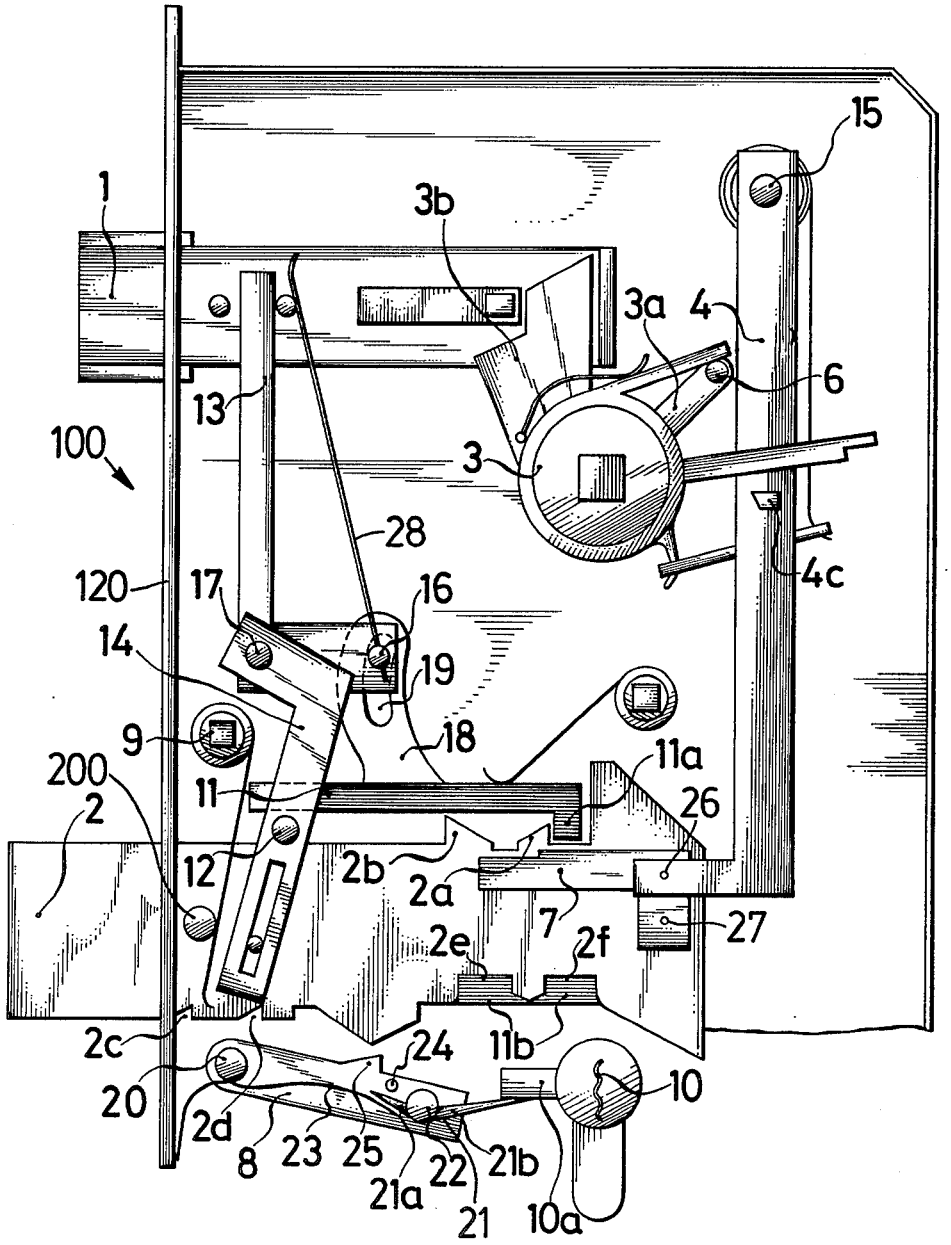
FIG. 1 is a cross-sectional view of the mortise lock in the practice of the invention.

The principles of the present invention find a particularly desirable application in a mortise lock and such a lock is shown in FIG. 1 generally at 100. The mortise lock is housed in a standard lock case 120 and has a latch member 1, a bolt member 2 and a locking hub 3 to whose shaft a door handle (not illustrated) is rigidly connected. The mortise lock 100 is provided with a rotary cylinder lock 10 having a stop nose or projection 10*a*. The latch member 1 is frictionally connected in a known manner to the locking hub 3, and thus to the door handle, by means of a hub arm 3*b* extending outwardly from the locking hub 3.

The body of latch member 1 is connected to the body of bolt member 2 by means of a pair of lever members 13, 14 which are mounted to a pivot 17 carried on lever 13. Lever 13 is rotatably mounted to a rigid housing axle 16, and a follower pin 12 is affixed to lever member 14. A bolt control lever 11 is positioned above bolt member 2. The follower pin 12 is disposed in such a manner that it undercuts the bolt control lever 11 such that, when the latch member 2 is actuated and the movement of lever member 13 is thereby determined, lever member 14 and bolt control lever 11 are elevated.

Bolt member 2 is biased so as to shift to its lock position by means of a spring member 9 which abuts a protrusion 200 on the bolt member 2. The bolt control lever 11 may at times oppose this biased tendency by means of a blocking element 11*a* which interacts with a pair of ratchets 2*a*, 2*b* formed along the upper longitudinal side of the bolt member 2. The movement of the bolt control lever 11 is guided by means of the housing axle 16 affixed to lever member 13 and which is capable of moving in a generally up and down direction in a corresponding slot 19 which is formed on a fixed projection member 18 formed as part of the bolt control lever 11.

When the bolt member 2 is in a retracted position, the blocking element 11*a* engages the front portion of ratchet 2*b* so as to prevent the advance of the bolt member 2 due to the bias of spring member 9 at an improper time. When the bolt member 2 is in the advance or forward position as shown in FIG. 1, the blocking element 11*a* has moved behind the ratchet 2*a* so as to prevent an unintentional retraction of the bolt 2.

A third lever 4 extends generally parallel to the lever members 13, 14, and is connected to a fourth lever member 7 by means of a hinge pin 26. Lever member 7 is connected to the bolt member 2 by means of a second hinge pin 27 and provides a second lever connection to the bolt control lever 11.

The third lever 4, which can be rotated around a rigid housing pin 15, is deflected by means of a second hub arm 3*a* which frictionally abuts against the third lever 4. The latch member 1 is retracted by means of the second hub arm 3*b* mounted to said locking hub 3 and abuting latch member 1. A spring member 28 biases the latch member 1 in a forward or engaged mode. The back and forth movement of the hub arms 3*a* and 3*b* is controlled by the actuation of the door handle (not shown). A second detent or follower pin 6 is carried on the distal portion of the hub arm 3*a* and rests against the third lever 4.

A pair of recesses or stop detents 2*e*, 2*f* are positioned along the lower longitudinal edge of the bolt member 2 and into which recesses 2*e*, 2*f* bolt control lever 11 projects. The stop nose 10*a* engages stop detents 2*e*, 2*f* when the rotary cylinder lock 10 is rotated in a clockwise fashion, enabling bolt control lever 11 to be lifted out of the locking relationship existing between locking element 11*a* and ratchet 2*a*, and permitting bolt member 2 to be retracted.

A second blocking lever 8 is positioned below bolt member 2 and is rotatable around a pin member 20. Mounted to the blocking lever 8 is an auxiliary lever 21 having a pair of arms 21*a*, 21*b* and which is rotatably mounted about a central pin 22 attached to the blocking lever 8 and which is under the influence of a spring member 23 affixed around pin member 20. Spring 23 directs a force so as to bias the lever arm 21*a* against an abutment member 24 carried on the blocking lever 8. A locking nose 25 is formed on the surface of blocking lever 8 whereby the locking nose 25 enters into engagement with a pair of correspondingly designed recesses 2*c*, 2*d* formed along the lower surface of the bolt member 2. As shown in FIG. 2, the purpose of the lever arm 21*b* is to enter into interaction with the stop nose 10*a*, whereby, when the bolt member 2 is retracted, the lever arm 21*b* lies above the stop nose 10*a*, and the locking nose 25 falls into the recess 2*c*, whereby bolt member 2 is prevented from emerging. As shown in FIG. 3, when the key withdrawal position as been reached, lever arm 21*b* again lies under stop nose 10*a* and the bolt member 2 has been unlocked.

The key withdrawal position is achieved by means of a short clockwise turn of a key member (not shown) which results in the stop nose 10*a* passing over the auxiliary lever 21 so that lever arm 21*b* is positioned under stop nose 10*a*. In order to be able to withdraw the key from the lock, a short, counter-clockwise turn of the key is necessary, with the result that the blocking lever 8 is rotated by means of the stop nose 10*a* in such a manner that the lock nose 25 has disengaged from bolt member 2. Thus, in order for the user to obtain the advantage of the automatic locking of the door when it is closed or by means of the operating handle, the key must be withdrawn from the lock.

The bolt member 2 may be engaged by means of the door handle (not shown) as follows. When the latch member 1 is retracted, the lever member 13 is rotated clockwise around the rigid housing axle 16, whereby the second lever member 14, rotatably hinged to the lever member 13 at pivot point 17, is lifted up and undercuts the bolt control lever by means of the follower pin 12, lifting the blocking element 11*a* out of engagement with the ratchet 2*b*. Under the forward pressure of the spring member 9, the unlocked bolt member 2 can now move into the double locking position as shown in FIG. 1, under the precondition that the cylinder lock 10 is in its key withdrawal position and, thus, the blocking lever 8 is rotated down and rendered ineffective with respect to recesses 2*c*, 2*d*. As shown, in FIG. 1, the bolt control lever 11 is rigidly held in place by means of the engagement of blocking element 11*a* with ratchet 2*a*, making it impossible to press the bolt member 2 back into the lock case 120 without authorization.

The bolt member 2 may be retracted from its advanced lock position by means of the door handle (not shown) as follows. A clockwise rotation of the door handle (not shown) results in the counter-clockwise deflection of lever 4 by means of the hub arm 3*a* which lies frictionally abutting against it. Lever 7, which is rotatably hinged to the lever 4 by means of the hinge pin 26 is also connected to the bolt member 2 by means of pin 27. The counter-clockwise excursion of lever 4 results in a corresponding clockwise rotation of lever 7 about pin 27. This results in the blocking element 11*a* of bolt control lever 11 being lifted and disengaged from the ratchet member 2*a* together with the corresponding retraction of bolt member 2. Continued retraction of bolt member 2 results in the engagement of blocking element 11*a* against the ratchet member 2*b*.

When the door is closed, the latch 1 moves toward the right, as it is pressed in. The lever connection 13, 14 is placed in motion and the bolt control lever 11 is raised up due to the follower pin 12 carried by lever 14. The result is that the blocking element 11*a* leaves its stop position at 2*b* and that the bolt 2 thrusts forward to an extended position under the influence of spring 9.

The retraction of the bolt member 2 by means of the rotary cylinder lock 10 is as follows. Prior to the engagement of the stop nose 10*a* into the stop detent 2*e*, the bolt control lever 11*b* projecting into the detents 2*e*, 2*f* is lifted up by the stop nose 10*a* and thus, the engagement of the blocking element 11*a* with the ratchet 2*a* is eliminated. The bolt member 2 is retracted by means of the stop nose 10*a* engaging in a known manner with the lock detents 2*e*, 2*f*, while at the same time the engagement of locking nose 25 into recesses 2*c*, 2*d* is brought about by the blocking lever 8 being elevated by means of the stop nose 10*a* assuming its position below lever arm 21*b*.

Although various modifications might be suggested by those versed in the art, it should be understood that I wish to embody within the scope of the patent warranted hereon all such modifications as reasonable and properly come within my contribution to the art.

I claim as my invention

1. A mortise lock comprising:

a lock case;

a latch member mounted within said lock case;

a bolt member positioned below said latch member within said lock case;

a pair of L-shaped lever members pivotally connected to each other and slidingly and swingingly to said latch member and said bolt member, respectively;

a spring member positioned within said lock case and biasing said bolt member toward the engaged or forward position;

a bolt control lever slidingly and swingingly connected to one of said L-shaped lever members and capable of controlling the position or mode of said bolt member;

a third L-shaped lever mounted at one end to said lock case;

a fourth L-shaped lever pivotally affixed by some means to said bolt member;

means for pivotally connecting said third and fourth L-shaped lever arms to one another;

a locking hub rotatably mounted within said lock case;

at least one hub arm extending outwardly from said locking hub so as to abut said third L-shaped lever;

at least one hub arm extending outwardly from said locking hub and engaging said latch member so as to be capable of retracting said latch member upon rotation of said locking hub;

a blocking lever rotatably mounted to said lock case and positioned below said bolt member so as to maintain the bolt member in a retracted mode until disengaged; and a rotary cylinder lock mounted within said lock having at least one stop nose so as to enable a user to retract or engage said bolt member while simultaneously engaging or disengaging said blocking lever by means of a key.

2. The mortise lock of claim 1 in which said latch member of claim 1 is biased in the forward or engaged position by means of a spring.

3. The mortise lock of claim 1 in which said bolt member has two or more ratchets formed on its upper surface.

4. The mortise lock of claim 1 in which said bolt member has two or more recesses formed on its lower surface.

5. The mortise lock of claim 1 in which said bolt member has two or more step detents formed on its lower surface.

6. The mortise lock of claim 3 in which a blocking element is formed on said bolt control lever so as to engage said ratchets formed on said bolt member.

7. The mortise lock of claim 4 in which a locking nose is formed on the surface of said blocking lever so as to engage said recesses formed on said bolt member to prevent forward movement of said bolt member when not desired.

8. The mortise lock of claim 1 in which a two-armed auxiliary lever is pivotally mounted to said blocking lever so as to be abuted on the upper or lower face of one of its arms by said stop nose of said rotary cylinder lock so as to engage or disengage said blocking lever.

9. The mortise lock of claim 1 in which a follower pin is mounted to one of said pair of L-shaped lever members so as to lift and disengage said bolt control lever to enable said bolt member to be retracted.

* * * * *